US009448032B2

(12) United States Patent
Vincent, Jr.

(10) Patent No.: US 9,448,032 B2
(45) Date of Patent: Sep. 20, 2016

(54) EXPANDABLE BOW CAM

(71) Applicant: Johnny Hayden Vincent, Jr., Dorris, CA (US)

(72) Inventor: Johnny Hayden Vincent, Jr., Dorris, CA (US)

( * ) Notice: Subject to any disclaimer, the term of this patent is extended or adjusted under 35 U.S.C. 154(b) by 0 days.

(21) Appl. No.: 15/050,126

(22) Filed: Feb. 22, 2016

(65) Prior Publication Data

US 2016/0245612 A1 Aug. 25, 2016

Related U.S. Application Data

(60) Provisional application No. 62/118,499, filed on Feb. 20, 2015.

(51) Int. Cl.
*F41B 5/10* (2006.01)

(52) U.S. Cl.
CPC ..... *F41B 5/105* (2013.01)

(58) Field of Classification Search
CPC ..... F41B 5/10; F41B 5/105
See application file for complete search history.

(56) References Cited

U.S. PATENT DOCUMENTS

| | | | | |
|---|---|---|---|---|
| 6,691,692 | B1 * | 2/2004 | Adkins | F41B 5/10 124/25.6 |
| 7,082,937 | B1 * | 8/2006 | Land | F41B 5/105 124/25.6 |
| 8,205,607 | B1 * | 6/2012 | Darlington | F41B 5/105 124/23.1 |
| 8,360,041 | B2 * | 1/2013 | Strother | F41B 5/10 124/25.6 |

* cited by examiner

*Primary Examiner* — John Ricci

(57) ABSTRACT

An expandable bow cam increases the exit velocity of an arrow in comparison to a traditional bow cam. The expandable bow cam includes a mounting body, a first restraining member, a second restraining member, am expansion member, and a string track. The mounting body mounts the expandable bow cam onto a limb of a bow. The first restraining member and the second restraining member limit the range of the expansion member and provide support for the bow string to accommodate for the increased radius of the expandable bow cam. The expansion member increases the radius of the expandable bow cam as the bowstring is drawn such that the tension in the bowstring increases as the bowstring is released subsequently increasing the exit velocity of the arrow. The string track prevents the bowstring from becoming dislodged from the present invention as the bow is drawn and fired.

19 Claims, 8 Drawing Sheets

EXPANDABLE BOW CAM

The current application claims a priority to the U.S. Provisional Patent application Ser. No. 62/118,499 filed on Feb. 20, 2015. The current application is filed on Feb. 22, 2016 while Feb. 20, 2016 was on a weekend.

FIELD OF THE INVENTION

The present invention relates generally to a cam for compound bows. More specifically, the present invention is a bow cam which expands when the bowstring is drawn to increase tension on the bowstring.

BACKGROUND OF THE INVENTION

Compound bows are commonly used for hunting and for sport. Compound bows rely on one or more cams or pulleys which are used to supply a mechanical advantage when the bow is drawn and released. Tension of the bowstring is increased by the archer as the archer pulls the bowstring back in order to fire an arrow. Cams and pulleys decrease the amount of force which the archer must input in order to fire an arrow by effectively transferring the tension force to a propellant force on the arrow.

Accordingly, there is a present need for a cam that is capable of expanding to maximize the amount of contact it has with the bowstring and, in turn, the amount of tension that the bowstring experiences. The present invention is a bow cam that expands as the string is drawn and locks into place at full draw. Intermittently increasing the radius of a cam as the bowstring is pulled back would increase the distance which bowstring needs to travel to return to rest. As a result, the archer experiences no added resistance when drawing back the bow, but the bowstring experiences an increased tension as the bowstring retracts to the resting position, which translates to an increase of the expelling force on the arrow.

DETAIL DESCRIPTIONS OF THE INVENTION

All illustrations of the drawings are for the purpose of describing selected versions of the present invention and are not intended to limit the scope of the present invention.

The present invention is an expandable bow cam. The present invention augments a bow for archery to increase the force to expel an arrow without increasing the force that the archer must exert on the bowstring to fully draw the bow. The present invention increases the radius of the expandable bow cam as the bow is fully drawn such that the tension force is increased as the bowstring retracts into the resting position. The present invention is affixed to the terminal end of a compound bow limb, such that the cam rotates as the bowstring is dawn to fire an arrow.

Figure 1:
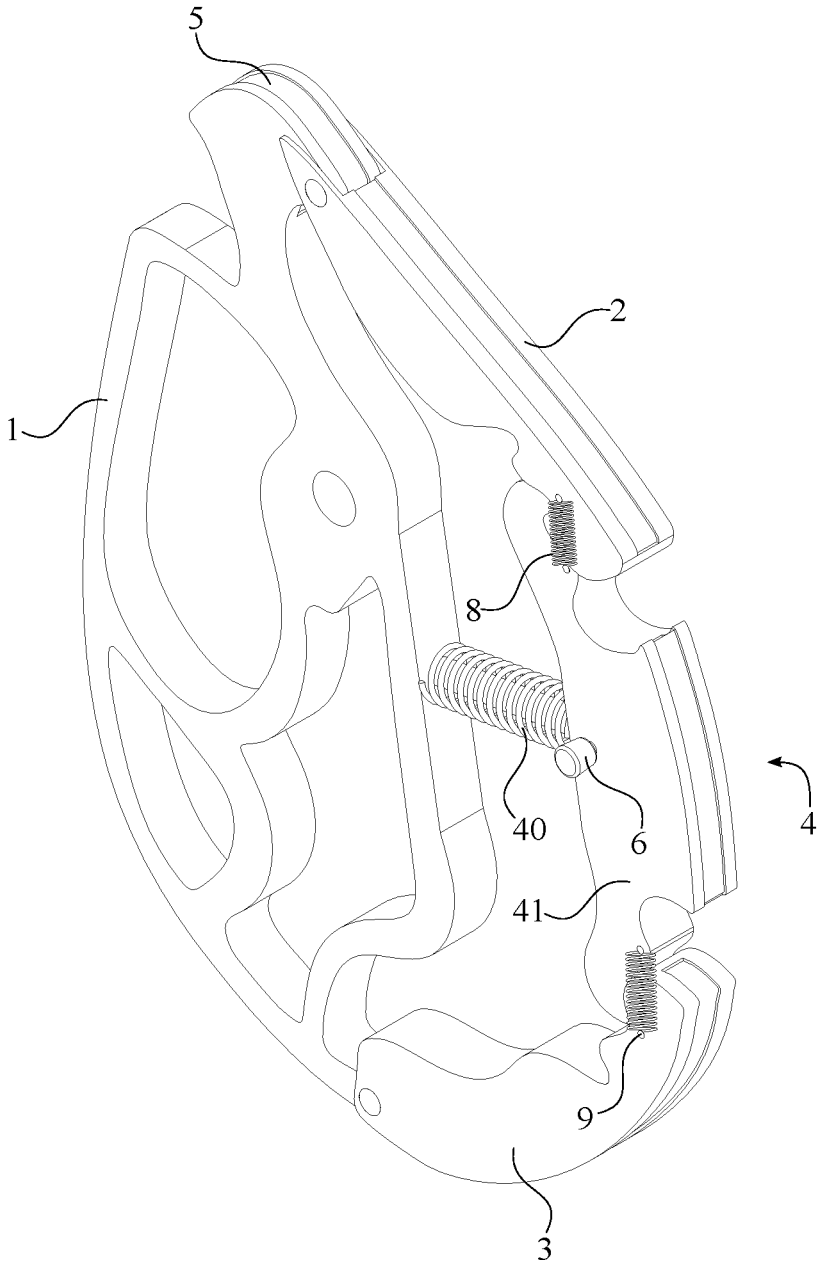
FIG. 1 is a perspective view of the present invention.

In accordance to FIG. 1, the present invention comprises a mounting body 1, a first restraining member 2, a second restraining member 3, an expansion member 4 and a string track 5. The mounting body 1 allows the present invention to be secured onto a terminal end of a compound bow limb for implementation of the present invention. The expansion member 4 allows for the radius of the present invention to be variable. In order to facilitate this aspect, the expansion member 4 is slidably connected to the mounting body 1, such that the expansion member 4 extends and retracts radially about the present invention. The expansion member 4 is positioned between the first restraining member 2 and the second restraining member 3. The first restraining member 2 and the second restraining member 3 limit the variability in the present invention's radius while providing a consistent perimeter profile for the bowstring to interface. The first restraining member 2 is pivotally connected to the mounting body 1. The first restraining member 2 engages the expansion member 4 in order to facilitate the restriction in the radial movement of the expansion member 4 as well as provide a smooth engagement curvature of the bowstring during implementation of the present invention. Similarly, the second restraining member 3 is pivotally connected to the mounting body 1. The second restraining member 3 is positioned opposite to the first restraining member 2 along the mounting body 1. The second restraining member 3 engages the expansion member 4 in order to facilitate the restriction in the radial movement of the expansion member 4 as well as provide a smooth engagement curvature of the bowstring during implementation of the present invention. The first restraining member 2 and the second restraining member 3 apply equivalent forces evenly across the expansion member 4 in order to reduce friction between the expansion member 4 and the mounting body 1 through the sliding connection. The string track 5 prevents the bowstring from being dislodged from the present invention as bow is fully drawn and the radius of the present invention varies. The string track 5 is perimetrically integrated about the mounting body 1, the first restraining member 2, the second restraining member 3 and the expansion member 4 in order to continuously engage the bowstring. When the bow is drawn, the present invention rotates about the connection point to the bow due to the friction between the bowstring and the present invention.

Figure 2:
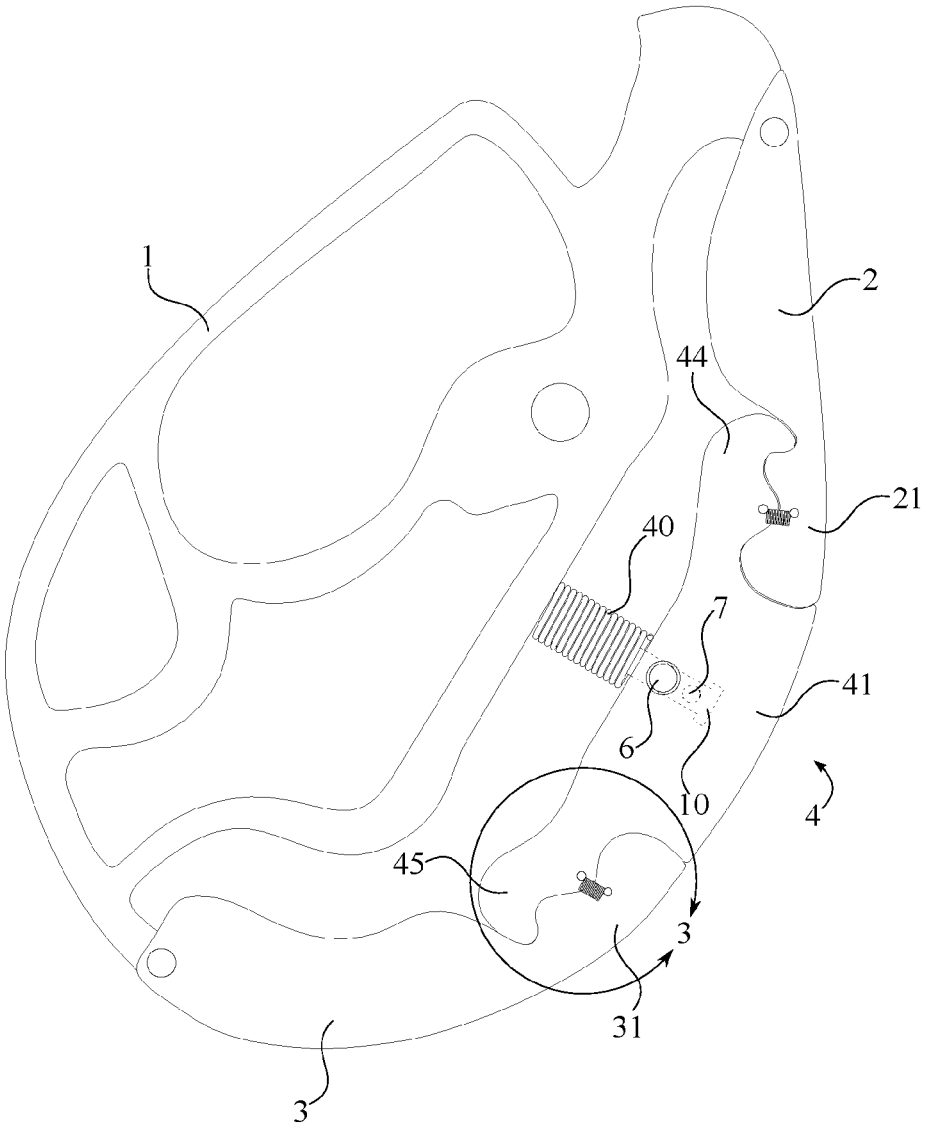
FIG. 2 is a side view of the present invention, wherein the present invention is in a collapsed position.
Figure 4:
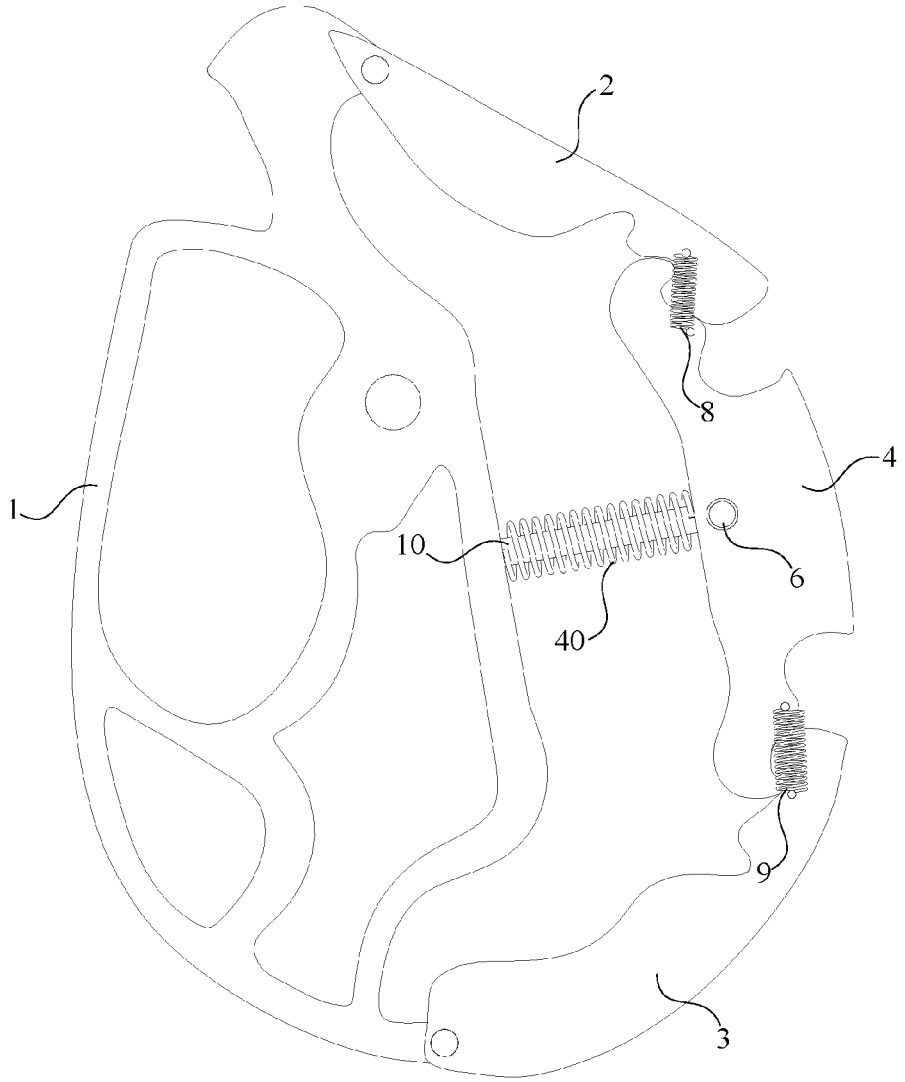
FIG. 4 is a side view of the present invention, wherein the present invention is in an expanded position.
Figure 6:
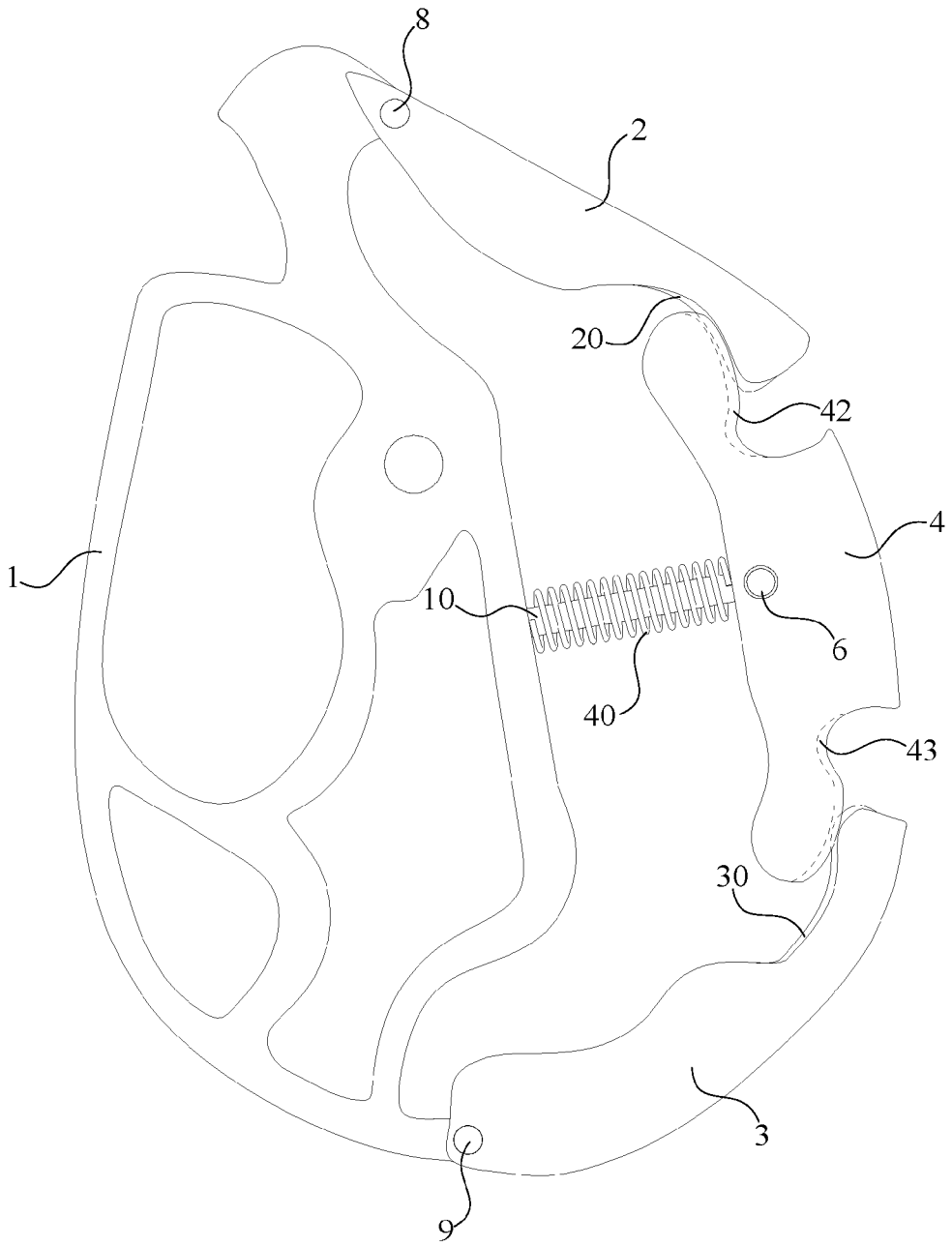
FIG. 6 is a side view of the present invention, wherein the present invention includes a first alignment protrusion, a second alignment protrusion, a first alignment groove, and a second alignment groove.

In accordance to the preferred embodiment of the present invention, the mounting body 1 comprises a mounting rod 10, as shown in FIG. 2, FIG. 4, and FIG. 6. The mounting rod 10 provides a support for the expansion member 4 to translate radially within the present invention from the mounting body 1. The expansion member 4 comprises a spring 40 and a string engagement member 41. The string engagement member 41 is the portion of the expansion member 4 which interfaces with the bowstring. The mounting rod 10 is perpendicularly oriented to the string engagement member 41. The string engagement member 41 is slideably engaged with the mounting rod 10. The spring 40 is concentrically positioned around the mounting rod 10 in order to allow the string engagement member 41 to extend as pressure from the bowstring is released from the string engagement member 41.

Figure 7:
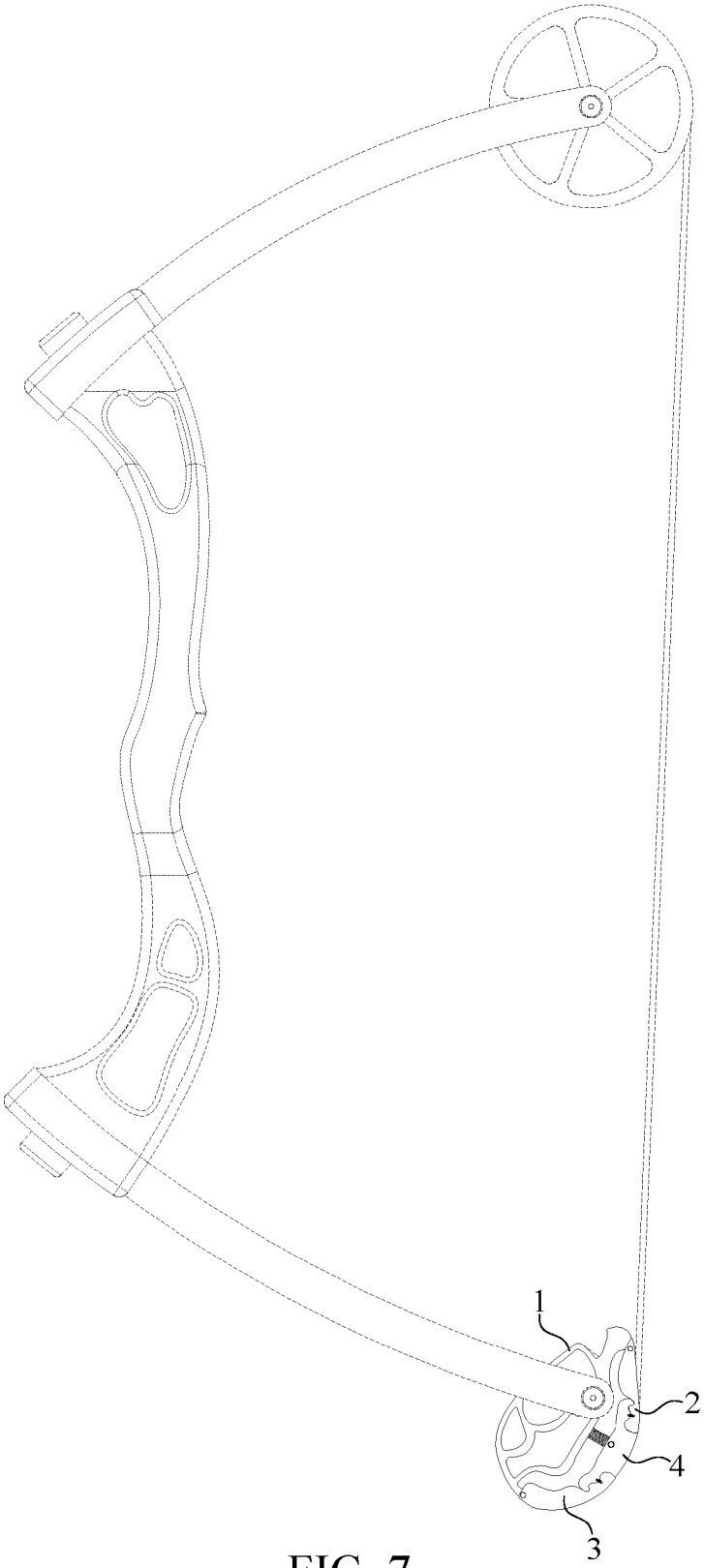
FIG. 7 is a side view of the present invention in the collapsed position, wherein the present invention is mounted onto a bow with the bowstring in the rest position.

In some embodiments of the present invention, the present invention comprises a locking pin 6 and a locking pin receiver 7, in accordance to FIG. 2. The locking pin 6 and the locking pin receiver 7 secure the string engagement member 41 in an expanded position. The locking pin 6 traverses through the string engagement member 41 such that the locking pin 6 presses against the mounting rod 10. The locking pin receiver 7 laterally traverses into the mounting rod 10. The locking pin receiver 7 is oriented towards the locking pin 6 in order to receive the locking pin 6. The locking pin receiver 7 is terminally positioned along the mounting rod 10, such that when the locking pin 6 is positioned within the locking pin receiver 7, the string engagement member 41 is locked in the expanded position. When the bowstring is released to fire an arrow, the pressure from the tension of the bowstring does not compress the string engagement member 41 towards the mounting body 1 as the bowstring returns to resting position, as shown in FIG. 7. Therefore, the increased radius of the present invention is maintained through the firing of a bow. The archer is able to release the locking pin 6 by pulling on the locking pin 6 in order to reset the expansion member 4 to the initial position for implementation.

In accordance to preferred embodiment of the present invention, the present invention comprises a first angular retention mechanism 8 and a second angular retention mechanism 9. The first angular retention mechanism 8 and the second angular retention mechanism 9 apply a moment to the first restraining member 2 and the second restraining member 3, respectively. These moments force the first restraining member 2 and the second restraining member 3 against the expansion member 4.

In some embodiments of the first angular retention mechanism 8 and the second angular retention mechanism 9, the first angular retention mechanism 8 and the second angular retention mechanism 9 are tension springs, as shown in FIG. 1 and FIG. 4. The first angular retention mechanism 8 is terminally mounted to the first restraining member 2. The first angular retention mechanism 8 is terminally mounted to the expansion member 4. The second angular retention mechanism 9 is terminally mounted to the second restraining member 3. The second angular retention mechanism 9 is terminally mounted to the expansion member 4. The second angular retention mechanism 9 is opposite to the first angular retention mechanism 8 across the expansion member 4. Therefore, as the expansion member 4 extends away from the mounting body 1, the first angular retention mechanism 8 and the second angular retention mechanism 9 expand from a rest position between the expansion member 4 and the first restraining member 2 and the second restraining member 3, respectively. The tendency for the tension spring 40 to return to rest presses the first restraining member 2 and the second restraining member 3 onto the expansion member 4 towards the mounting body 1.

Figure 5:
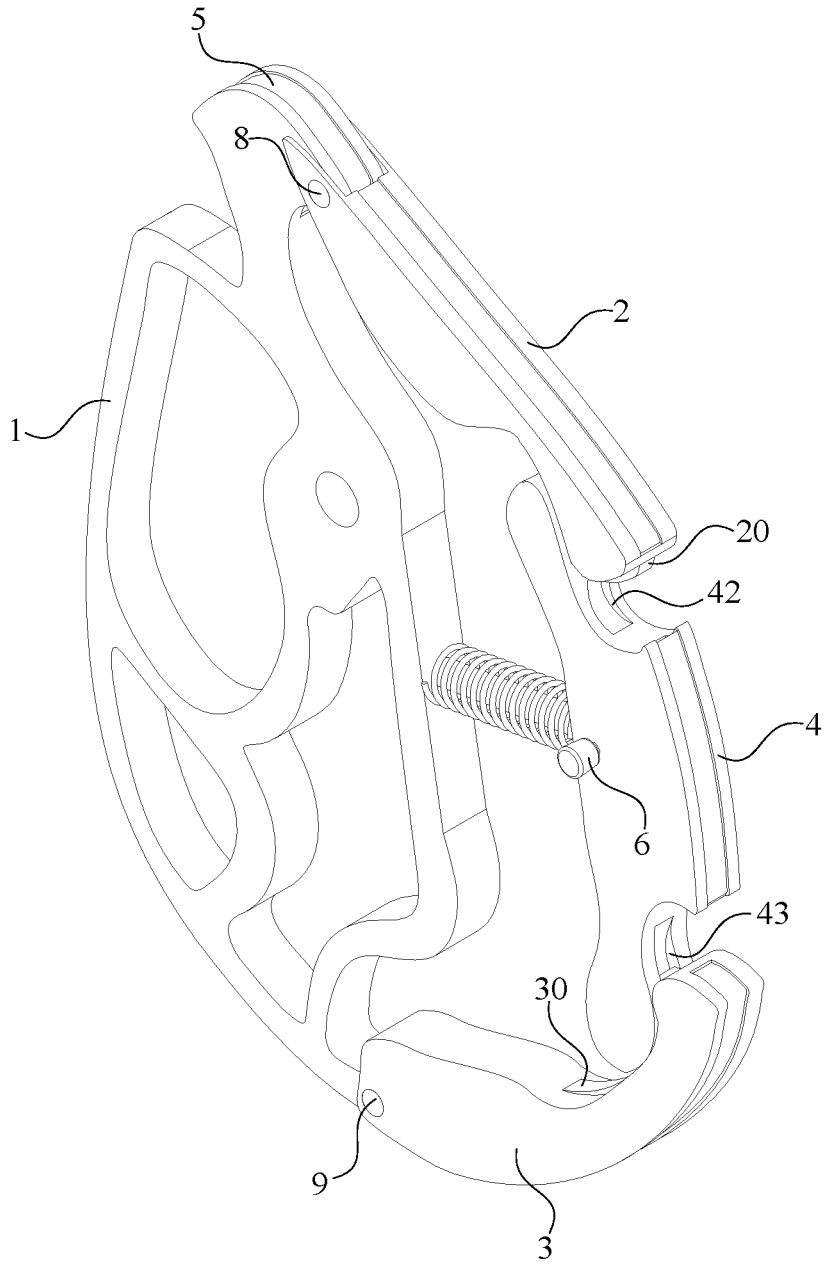
FIG. 5 is a perspective view of the present invention, wherein the present invention includes a first alignment protrusion, a second alignment protrusion, a first alignment groove, and a second alignment groove.

In some other embodiments of the first angular retention mechanism 8 and the second angular retention mechanism 9, the first angular retention mechanism 8 and the second angular retention mechanism 9 are torsion springs, as shown in FIG. 5 and FIG. 6. The first angular retention mechanism 8 is mechanically integrated into the pivot connection between the first restraining member 2 and the mounting body 1. Similarly, the second angular retention mechanism 9 is mechanically integrated into the pivot connection between the second restraining member 3 and the mounting body 1. Therefore, as the expansion member 4 extends away from the mounting body 1, the first angular retention mechanism 8 and the second angular retention mechanism 9 rotate from a rest position as the first restraining member 2 and the second restraining member 3, respectively, pivot about the expansion member 4. The tendency for the torsion spring to return to rest presses the first restraining member 2 and the second restraining member 3 onto the expansion member 4 towards the mounting body 1.

In some embodiments of the present invention, the expansion member 4 comprises a first alignment groove 42, and the first restraining member 2 comprises a first alignment protrusion 20, in accordance to FIG. 5 and FIG. 6. The first alignment groove 42 is adjacently positioned to the first restraining member 2. The first alignment protrusion 20 is adjacently positioned to the expansion member 4. The first alignment protrusion 20 being slideably engaged with the first alignment groove 42. This configuration prevents the rotation of the expansion member 4 about the mounting rod 10 as force is applied to the expansion member 4 through the first restraining member 2.

Similarly, in some embodiments of the present invention, the expansion member 4 comprises a second alignment groove 43, and the second restraining member 3 comprises a second alignment protrusion 30, in accordance to FIG. 5 and FIG. 6. The second alignment groove 43 is adjacently positioned to the second restraining member 3. The second alignment protrusion 30 is adjacently positioned to the expansion member 4. The second alignment protrusion 30 being slideably engaged with the second alignment groove 43. Likewise, this configuration prevents the rotation of the expansion member 4 about the mounting rod 10 as force is applied to the expansion member 4 through the second restraining member 3.

In still other embodiments of the present invention, the first restraining member 2 comprises a first tiered clasping end 21, the second restraining member 3 comprises a second tiered clasping end 31, and the expansion member 4 comprises a first tiered clasping receiver 44 and a second tiered clasping receiver 45, in accordance to FIG. 2. The first tiered clasping end 21, the second tiered clasping end 31, the first tiered clasping receiver 44, and the second tiered clasping receiver 45 allow the expansion member 4 to be positioned at select interval distances from the mounting body 1. The first tiered clasping end 21 is positioned adjacent to the expansion member 4. The first tiered clasping receiver 44 is positioned adjacent to the first restraining member 2. Similarly, the second tiered clasping end 31 is positioned adjacent to the expansion member 4. The second tiered clasping receiver 45 is positioned adjacent to the second restraining member 3.

As previously mentioned, the first tiered clasping end 21, the second tiered clasping end 31, the first tiered clasping receiver 44, and the second tiered clasping receiver 45 allow the expansion member 4 to be positioned at select interval distances from the mounting body 1. Thus, the first tiered clasping end 21, the second tiered clasping end 31, the first tiered clasping receiver 44, and the second tiered clasping receiver 45 allow the present invention to be configured into an expanded position and a collapsed position. As the bowstring is drawn, the force of the spring 40 overcomes the pressure of the first restraining member 2 and the second restraining member 3 on the expansion member 4, when the expansion member 4 rotates away from the bowstring. As the expansion member 4 is distanced from the mounting body 1 by the spring 40, the first tiered clasping end 21 and the first tiered clasping receiver 44 engage in the expanded position. Simultaneously, the second tiered clasping end 31 and the second tiered clasping receiver 45 engage in the expanded position. In the expanded position, a distal tier of the first tiered clasping end 21 engages a distal tier of the first tiered clasping receiver 44. Similarly, a distal tier of the second tiered clasping end 31 engages a distal tier of the second tiered clasping receiver 45. This configuration secures the present invention in the expanded position. Pressure applied from the bowstring returns to the expansion member 4 to the collapsed position when the bowstring returns to the resting position and the locking pin 6 is removed from the locking pin receiver 7.

Figure 3:
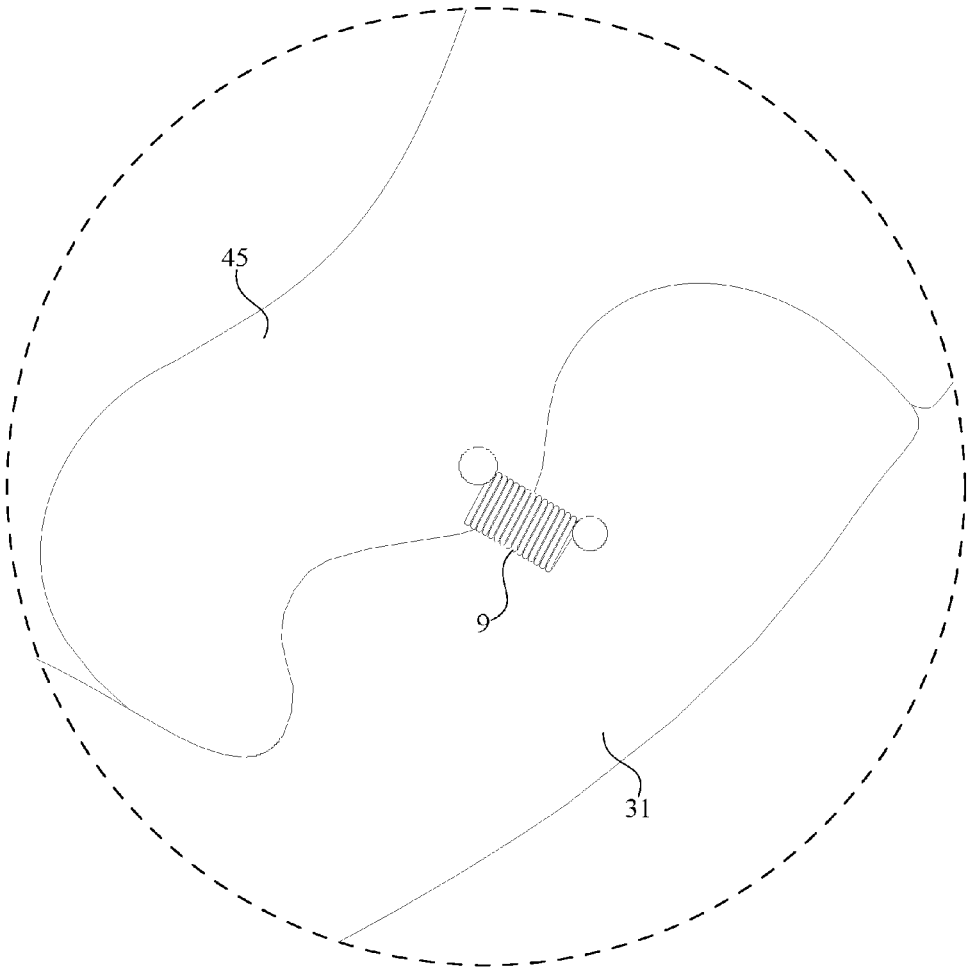
FIG. 3 is a detailed view of the second tiered clasping end and the second tiered clasping receiver.
Figure 8:
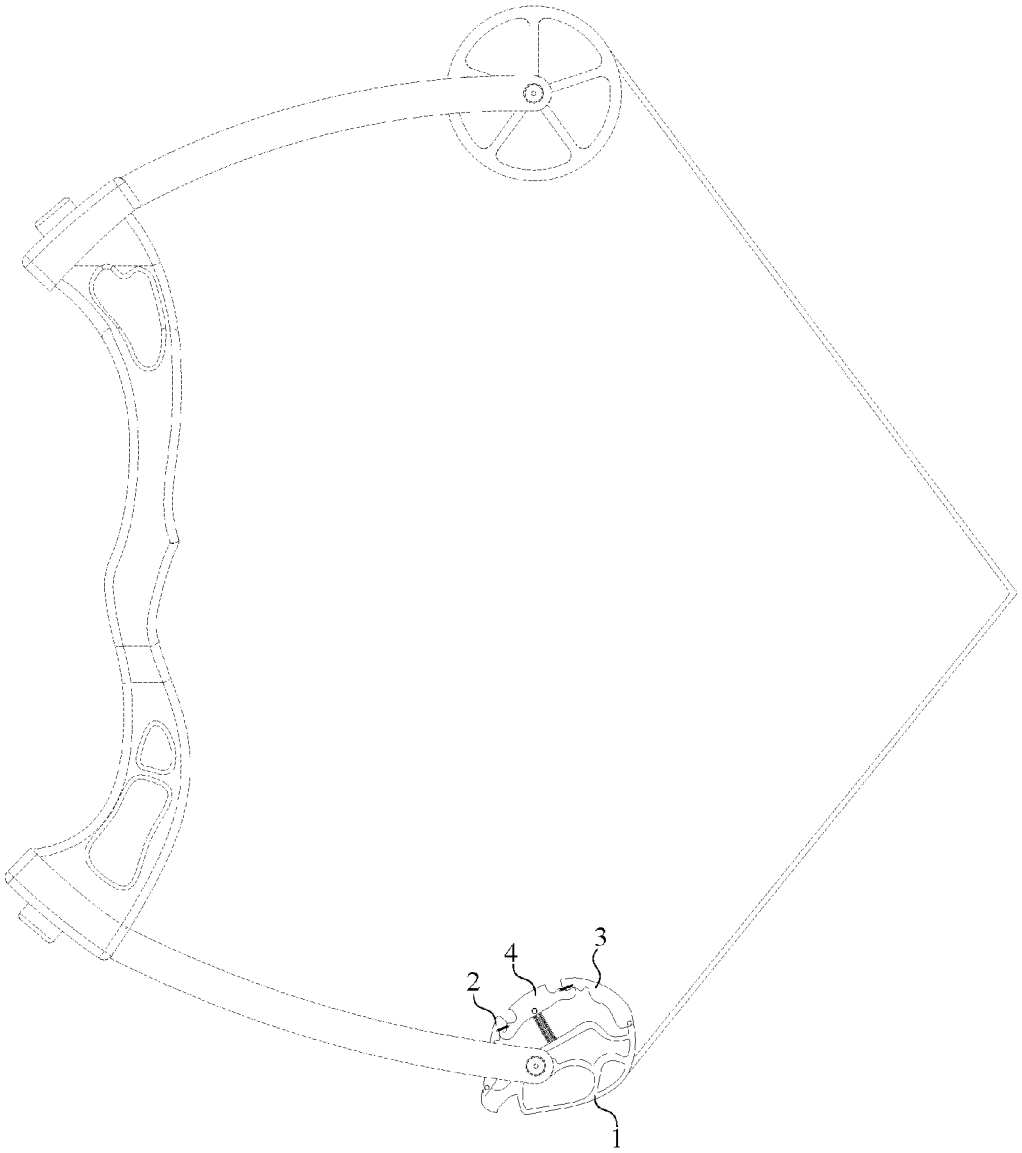
FIG. 8 is a side view of the present invention in the expanded position, wherein the present invention is mounted onto a bow with the bowstring in the drawn position.

Prior to the bow being drawn, the first tiered clasping end 21 and the first tiered clasping receiver 44 engage in a collapsed position. Similarly, the second tiered clasping end 31 and the second tiered clasping receiver 45 engaged in a collapsed position. In the collapsed position, the distal tier of the first tiered clasping end 21 engages a proximal tier of the first tiered clasping receiver 44. Likewise, the distal tier of the second tiered clasping end 31 engages a proximal tier of the second tiered clasping receiver 45, as detailed in FIG. 3. Further in the position, the spring 40 is pressed against the mounting body 1 by string engagement member 41. This configuration allows for the archer to easily draw the bow, the present invention to transition from the collapsed position, shown in FIG. 7, to the expanded position, shown in FIG. 8, and increase the tension on the bowstring as the bowstring is released, increasing the velocity of the expelled arrow.

Although the invention has been explained in relation to its preferred embodiment, it is to be understood that many other possible modifications and variations can be made without departing from the spirit and scope of the invention as hereinafter claimed.

What is claimed is:

1. An expandable bow cam comprises:
- a mounting body;
- a first restraining member;
- a second restraining member;
- an expansion member;
- a string track;
- the first restraining member being pivotally connected to the mounting body;
- the second restraining member being pivotally connected to the mounting body,
- the second restraining member being positioned opposite to the first restraining member along the mounting body;
- the expansion member being slidably connected to the mounting body;
- the expansion member being positioned between the first restraining member and the second restraining member;
- the first restraining member engaging the expansion member;
- the second restraining member engaging the expansion member, opposite to the first restraining member; and
- the string track being perimetrically integrated about the mounting body, the first restraining member, the second restraining member and the expansion member.

2. The expandable bow cam, as claimed in claim 1, comprises:
- the mounting body comprises a mounting rod;
- the expansion member comprises a spring and a string engagement member;
- the mounting rod being perpendicularly oriented to the string engagement member;
- the string engagement member being slideably engaged with the mounting rod; and
- the spring being concentrically positioned around the mounting rod;
- the spring being pressed against the mounting body by the string engagement member.

3. The expandable bow cam, as claimed in claim 2, comprises:
- a locking pin;
- a locking pin receiver;
- the locking pin traversing through the string engagement member;
- the locking pin receiver laterally traversing into the mounting rod; and
- the locking pin receiver being terminally positioned along the mounting rod.

4. The expandable bow cam, as claimed in claim 3, comprises:
- the locking pin being positioned within the locking pin receiver.

5. The expandable bow cam, as claimed in claim 1, comprises:
- a first angular retention mechanism;
- a second angular retention mechanism;
- the first angular retention mechanism being terminally mounted to the first retaining member;
- the first angular retention mechanism being terminally mounted to the expansion member;
- the second angular retention mechanism being terminally mounted to the second retaining member;
- the second angular retention mechanism being terminally mounted to the expansion member; and
- the second angular retention mechanism being opposite to the first angular retention mechanism across the expansion member.

6. The expandable bow cam, as claimed in claim 1, comprises:
- a first angular retention mechanism;
- a second angular retention mechanism;
- the first angular retention mechanism being mechanically integrated into the pivot connection between the first restraining member and the mounting body; and
- the second angular retention mechanism being mechanically integrated into the pivot connection between the second restraining member and the mounting body.

7. The expandable bow cam, as claimed in claim 1, comprises:
- the expansion member comprising a first alignment groove;
- the first restraining member comprising a first alignment protrusion;
- the first alignment groove being adjacently positioned to the first restraining member;
- the first alignment protrusion being adjacently positioned to the expansion member; and
- the first alignment protrusion being slideably engaged with the first alignment groove.

8. The expandable bow cam, as claimed in claim 1, comprises:
- the expansion member comprising a second alignment groove;
- the second restraining member comprising a second alignment protrusion;
- the second alignment groove being adjacently positioned to the second restraining member;
- the second alignment protrusion being adjacently positioned to the expansion member; and the second alignment protrusion being slideably engaged with the second alignment groove.

9. The expandable bow cam, as claimed in claim 1, comprises:

the first restraining member comprises a first tiered clasping end;

the expansion member comprises a first tiered clasping receiver;

the first tiered clasping end being positioned adjacent to the expansion member; and the first tiered clasping receiver being positioned adjacent to the first restraining member.

10. The expandable bow cam, as claimed in claim 1, comprises:

the second restraining member comprises a second tiered clasping end;

the expansion member comprises a second tiered clasping receiver;

the second tiered clasping end being positioned adjacent to the expansion member; and the second tiered clasping receiver being positioned adjacent to the second restraining member.

11. An expandable bow cam comprises:

a mounting body;

a first restraining member;

a second restraining member;

an expansion member;

a string track;

the mounting body comprises a mounting rod;

the expansion member comprises a spring and a string engagement member;

the first restraining member being pivotally connected to the mounting body;

the second restraining member being pivotally connected to the mounting body, the second restraining member being positioned opposite to the first restraining member along the mounting body;

the expansion member being slidably connected to the mounting body;

the expansion member being positioned between the first restraining member and the second restraining member;

the first restraining member engaging the expansion member;

the second restraining member engaging the expansion member, opposite to the first restraining member;

the string track being perimetrically integrated about the mounting body, the first restraining member, the second restraining member and the expansion member;

the mounting rod being perpendicularly oriented to the string engagement member;

the string engagement member being slideably engaged with the mounting rod; and the spring being concentrically positioned around the mounting rod;

the spring being pressed against the mounting body by the string engagement member.

12. The expandable bow cam, as claimed in claim 11, comprises:

a locking pin;

a locking pin receiver;

the locking pin traversing through the string engagement member;

the locking pin receiver laterally traversing into the mounting rod; and the locking pin receiver being terminally positioned along the mounting rod.

13. The expandable bow cam, as claimed in claim 12, comprises:

the locking pin being positioned within the locking pin receiver.

14. The expandable bow cam, as claimed in claim 11, comprises:

a first angular retention mechanism;

a second angular retention mechanism;

the first angular retention mechanism being terminally mounted to the first retaining member;

the first angular retention mechanism being terminally mounted to the expansion member;

the second angular retention mechanism being terminally mounted to the second retaining member;

the second angular retention mechanism being terminally mounted to the expansion member; and the second angular retention mechanism being opposite to the first angular retention mechanism across the expansion member.

15. The expandable bow cam, as claimed in claim 11, comprises:

a first angular retention mechanism;

a second angular retention mechanism;

the first angular retention mechanism being mechanically integrated into the pivot connection between the first restraining member and the mounting body; and the second angular retention mechanism being mechanically integrated into the pivot connection between the second restraining member and the mounting body.

16. The expandable bow cam, as claimed in claim 11, comprises:

the expansion member comprising a first alignment groove;

the first restraining member comprising a first alignment protrusion;

the first alignment groove being adjacently positioned to the first restraining member;

the first alignment protrusion being adjacently positioned to the expansion member; and the first alignment protrusion being slideably engaged with the first alignment groove.

17. The expandable bow cam, as claimed in claim 11, comprises:

the expansion member comprising a second alignment groove;

the second restraining member comprising a second alignment protrusion;

the second alignment groove being adjacently positioned to the second restraining member;

the second alignment protrusion being adjacently positioned to the expansion member; and the second alignment protrusion being slideably engaged with the second alignment groove.

18. The expandable bow cam, as claimed in claim 11, comprises:

the first restraining member comprises a first tiered clasping end;

the expansion member comprises a first tiered clasping receiver;

the first tiered clasping end being positioned adjacent to the expansion member; and the first tiered clasping receiver being positioned adjacent to the first restraining member.

19. The expandable bow cam, as claimed in claim 11, comprises:

the second restraining member comprises a second tiered clasping end;

the expansion member comprises a second tiered clasping receiver;

the second tiered clasping end being positioned adjacent to the expansion member; and the second tiered clasping receiver being positioned adjacent to the second restraining member.

* * * * *